US005431396A

United States Patent [19]

Shieh

[11] Patent Number: 5,431,396

[45] Date of Patent: Jul. 11, 1995

[54] GOLF CLUB HEAD ASSEMBLY

[76] Inventor: Tien W. Shieh, No. 74, Wen Heng Road, Fengshan City, Kaohsiung Hsien,

[21] Appl. No.: 137,971

[22] Filed: Oct. 19, 1993

[51] Int. Cl.[6] ..... A63B 53/04

[52] U.S. Cl. ..... 273/78; 273/167 H; 273/173

[58] Field of Search ..... 273/167 H, 78, 173, 273/174, 167 J, 167 C

[56] References Cited

U.S. PATENT DOCUMENTS 3,975,023 8/1976 Inamori ..... 273/173

4,884,812 12/1989 Nagasaki et al. ..... 273/167 H 5,261,664 11/1993 Anderson ..... 273/167 H

*Primary Examiner*—George J. Marlo

*Attorney, Agent, or Firm*—Jones, Tullar & Cooper

[57] ABSTRACT

A golf club head assembly includes a hollow shell having an endless inside flange spaced from a front opening thereof, a loop-like shock absorbing member fastened to the inside flange by an adhesive agent, a panel fastened to the shock absorbing member by an adhesive agent to block up the passage through the front opening of the hollow shell, and a striking plate fitted into a front recess on the panel and secured in place by an adhesive agent. The striking plate and the panel can be removed from the hollow shell for a replacement respectively when the adhesive agent is heated to melt.

4 Claims, 4 Drawing Sheets

GOLF CLUB HEAD ASSEMBLY

BACKGROUND OF THE INVENTION

The present invention relates to a golf club head assembly which is inexpensive to manufacture, and which can be conveniently assembled without the use of any screws.

The head of a conventional golf club, as shown in FIG. 7, is generally comprised of a hollow inner shell (5), a striking plate (7) fastened to the inner shell (5) by screws (6), and a plastic outer shell (8) covered over the hollow inner shell (5) and the border area of the striking plate (7). The striking plate (7) has a back recess (71) defining a hollow space (9) with the hollow inner shell (5) for buffering the impact upon striking of the golf club against the ball. This structure of golf club head is not satisfactory in function. Because the striking plate (7) is fastened to the the hollow inner shell (5) by screws (6), screw holes must be made on the striking plate and the hollow inner shell, and therefore the assembly process of this structure of golf club head is complicated and its manufacturing cost is relatively increased. Another disadvantage of this structure of golf club head is that the striking plate is not replaceable. If the striking plate is damaged, the whole assembly of the golf club head must be thrown away.

SUMMARY OF THE INVENTION

The present invention eliminates the aforesaid disadvantages. It is therefore the principal object of the present invention to provide a golf club head assembly for a golf club which is easy to assemble without the use of screws. It is another object of the present invention to provide a golf club head assembly for a golf club which is inexpensive to manufacture. It is still another object of the present invention to provide a replaceable striking plate for the golf club head assembly of a golf club.

According to one embodiment of the present invention, the golf club head is comprised of a hollow shell having an inside flange spaced from a front opening thereof, a shock absorbing member adhered to the inside flange, a panel adhered to the shock absorbing member to block up the front opening of the hollow shell, and a striking surface adhered to the panel. By heating the adhesive agent to melt, the striking plate and the panel can be conveniently removed from the hollow shell for a respective replacement when damaged. Because no screws are used to fasten the parts together, the assembly process of the golf club head assembly is easy, and therefore the manufacturing cost of the golf club head assembly can be relatively educed.

DETAILED DESCRIPTION OF THE PREFERRED EMBODIMENTS

Figure 1:
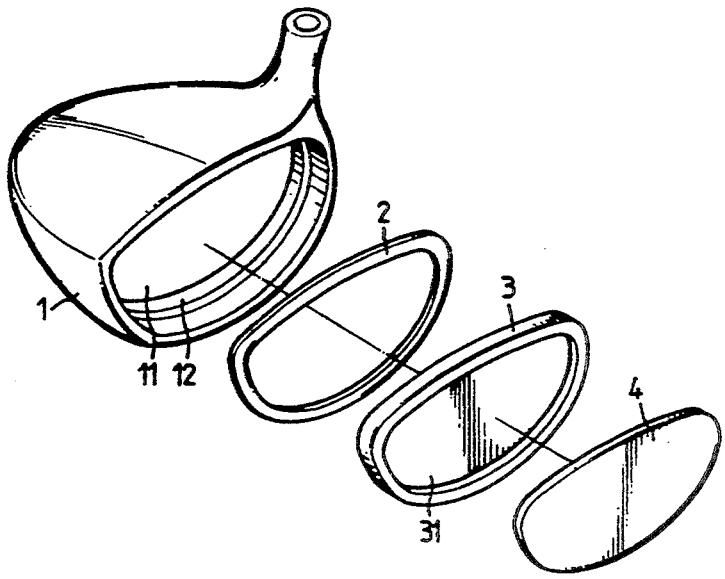
FIG. 1 is an exploded view of a golf club head assembly according to a first embodiment of the present invention.
Figure 2:
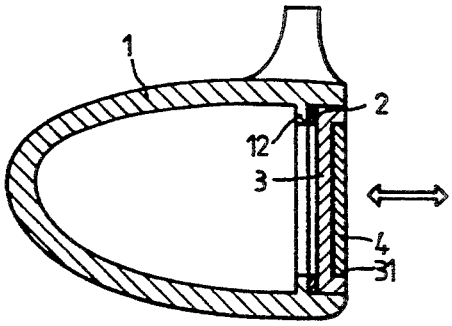
FIG. 2 is an assembly view in section of the golf club head assembly of FIG. 1.

Referring to FIGS. 1 and 2, a golf club head assembly in accordance with a first embodiment of the present invention is generally comprised of a hollow shell 1 having an endless flange 12 raised from the inside wall and equally spaced from a front opening 11 thereof, a loop-like shock absorbing member 2 adhered to the endless flange 12 by an adhesive agent, a panel 3 fastened to the loop-like shock absorbing member 2 to block up the passage through the front opening 11 and having a front recess 31, and a striking plate 4 fitted into the front recess 31 and adhered thereto by an adhesive agent. The striking plate 4 may be made of any of a variety of suitable materials including precision ceramic, engineering plastics, carbon fibers, titanium, glass fibers, silicon carbide, etc. The shock absorbing member 2 may be from silicon rubber or any suitable shock absorbing material.

When assembled, as shown in FIG. 2, the striking plate 4 is disposed in flush with the border of the hollow shell 1. Upon the strike against the ball, the striking plate 4 and the panel 3 are deformed to curve inwards and then they immediately return to their respective former shape, and therefore impact force is buffered. At the same time, the shock absorbing member 2 absorb shocks transmitted from the panel 3 and the striking plate 4.

Figure 3:
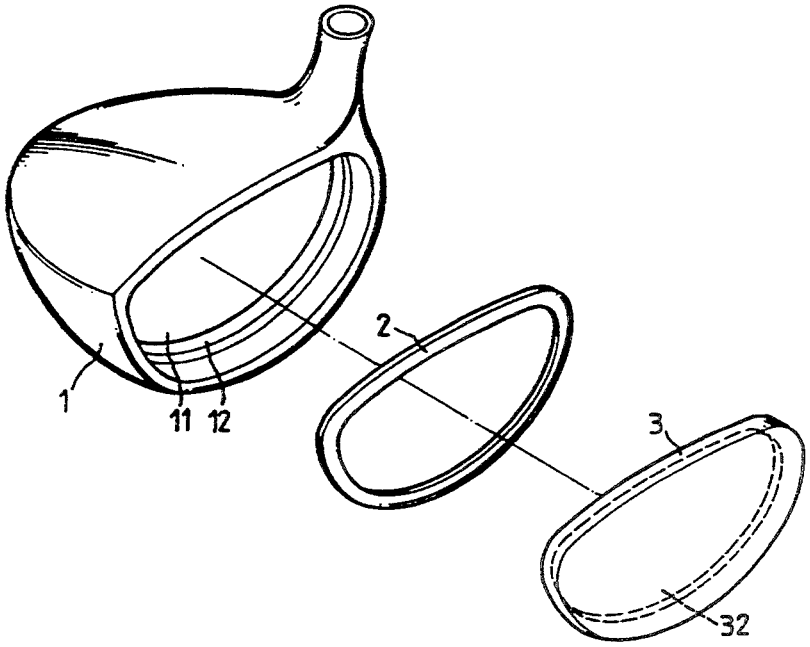
FIG. 3 is an exploded view of a golf club head assembly according to a second embodiment of the present invention.
Figure 4:
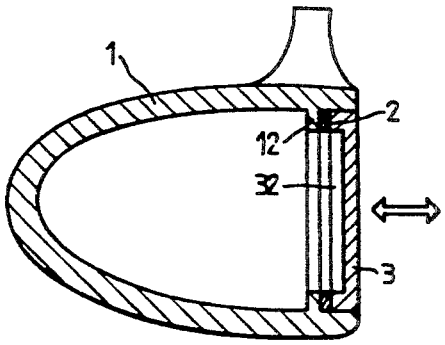
FIG. 4 is an assembly view in section of the golf club head assembly of FIG. 3.

Referring to FIGS. 3 and 4, therein illustrated is an alternate form of the present invention, in which the golf club head assembly is comprised of a hollow shell 1 having an endless flange 12 raised from the inside wall and equally spaced from a front opening 11 thereof, a loop-like shock absorbing member 2 adhered to the endless flange 12 by an adhesive agent, a panel 3 fastened to the loop-like shock absorbing member 2 to block up the passage through the front opening 1. In this alternate form, the striking plate 4 shown in FIGS. 1 and 2 is eliminated, and the panel 3 serves as a striking plate having a front surface disposed in flush with the border of the hollow inner shell 1 and a back recess 32 disposed inside the hollow inner shell 1. Upon the strike against the ball, the panel 3 is deformed to curve inwards and then it immediately returns to its former shape.

Figure 5:
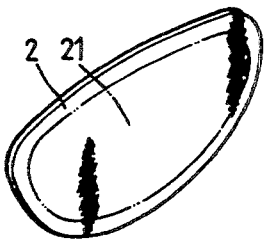
FIG. 5 is a perspective view of an alternate form of the shock absorbing member according to the present invention.
Figure 6:
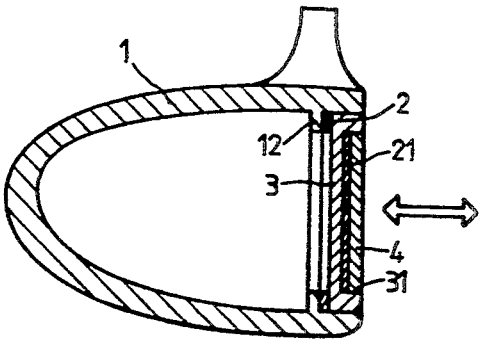
FIG. 6 is similar to FIG. 2 but showing the shock absorbing member of FIG. 5 installed.
Figure 7:
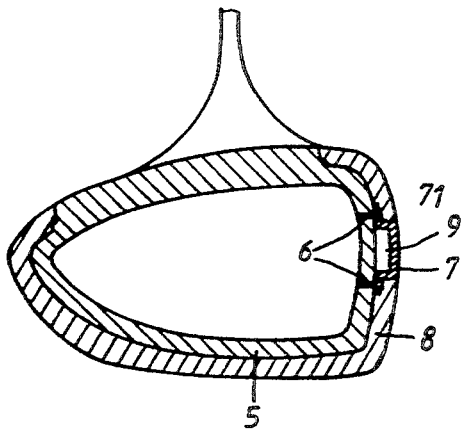
FIG. 7 (PRIOR ART)
FIG. 7 is a sectional view of a golf club head according to the prior art.

Referring to FIGS. 5 and 6, a stainless steel or carbon fiber wire cloth 21 is stretched within the shock absorbing member 3 and adhered to the panel 3 by an adhesive agent to improve the shock absorbing ability of the shock absorbing member 3.

While only a few embodiments of the present invention have been shown and described, it will be understood that various modifications and changes could be made without departing from the spirit and scope of the invention.

What is claimed is:

1. A golf club head assembly comprising:

a hollow shell having an endless flange raised from the inside wall and equally spaced from a front opening thereof;

a loop-like shock absorbing member adhered to said endless flange by an adhesive agent; and a panel fastened to said loop-like shock absorbing member to block up the passage through said front opening of said hollow shell.

2. The golf club head assembly of claim 1 wherein said panel has a front surface disposed in flush with the border of said hollow shell.

3. The golf club head assembly of claim 1 further comprising a striking plate fitted into a front recess on said panel and adhered thereto by an adhesive agent and disposed in flush with the border of said hollow shell.

4. The golf club head assembly of claim 1 wherein said loop-like shock absorbing member is covered with a wire cloth adhered to said panel by an adhesive agent.

* * * * *